United States Patent [19]

Irion

[11] 3,998,671

[45] Dec. 21, 1976

[54] PROCESS FOR THE MANUFACTURE OF A WATCH CASE WITH A VISIBLE HIGHLY INVARIABLE SURFACE

[75] Inventor: Ulrich Irion, Selzach, Switzerland

[73] Assignee: A. Schild S.A., Grenchen, Switzerland

[22] Filed: Dec. 18, 1973

[21] Appl. No.: 425,777

[30] Foreign Application Priority Data

Jan. 5, 1973 Switzerland ..... 105/73

[52] U.S. Cl. ..... 148/126; 75/200; 75/203; 75/204; 75/208 R

[51] Int. Cl.[2] ..... B22F 3/00

[58] Field of Search ..... 75/203, 204, 200, 208 R; 29/182.7, 182.8; 148/126

[56] References Cited

UNITED STATES PATENTS

| | | | |
|---|---|---|---|
| 3,647,576 | 3/1972 | Yamamura et al. | 148/126 |
| 3,655,365 | 4/1972 | Holtz | 75/203 |
| 3,655,458 | 4/1972 | Reichman | 75/203 |
| 3,690,062 | 9/1972 | Kasai | 58/88 |
| 3,698,878 | 10/1972 | Hale | 29/182.7 |
| 3,765,958 | 10/1973 | Freche et al. | 148/126 |
| 3,841,848 | 10/1974 | Kasai et al. | 75/205 |
| 3,880,600 | 4/1975 | Zboril | 75/205 |

OTHER PUBLICATIONS

Beguin, Swiss Watch and Jewelry Journal, July 1973, pp. 428–429.

Metals Handbook vol. 1, 8th Ed., 1961, pp. 256–257.

*Primary Examiner*—Brooks H. Hunt

*Attorney, Agent, or Firm*—Imirie, Smiley & Linn

[57] ABSTRACT

This invention relates to a process for the manufacture of a workpiece with a visible highly invariable surface characterized by the manufacture of a casting by sintering a mixture of powdered metal of one of at least one of the metals of the groups 4A, 5A and 6A of the periodic system of elements and a binding agent derived from one of at least one of the metals of the groups 1B and 8 of the periodic system; forming the casting to bring it in the definitive shape, finishing the face to be made invariable and submitting the thus obtained workpiece to heat-treatment for hardening it.

6 Claims, No Drawings

PROCESS FOR THE MANUFACTURE OF A WATCH CASE WITH A VISIBLE HIGHLY INVARIABLE SURFACE

This invention relates to a process for the manufacture of a workpiece with a visible highly invariable surface and a workpiece manufactured according to said process, comprising a visible highly invariable surface.

Some frequently used workpieces like parts of a watch case, parts of a wristlet and the like have advantageously invariable surfaces, that is surfaces which are resistant to corrosion in the ambient atmosphere and resistant to wear by accidental or periodical contact with hard solid materials.

Known processes for the manufacture of such workpieces have the disadvantage to be expensive, this limiting their industrial application.

It is the aim of the present invention to provide a process which eliminates the above mentioned disadvantage while maintaining the advantages of known processes.

The process according to the invention for the manufacture of a workpiece with a visible highly invariable surface is characterized by the manufacture of a casting by sintering a mixture of powdered metal of at least one of the metals of the groups 4A, 5A and 6A of the periodic system of elements and a binding agent derived from at least one of the metals of the groups 1B and 8 of the periodic system; forming the casting to bring it into the definitive shape, finishing the surface to be made invariable and submitting the resulting workpiece to a heat-treatment for hardening it. The basic idea of this invention is the fact that sintering of the mentioned mixtures can be performed at a temperature of about 1400° C to 1500° C if the nature of the respective binding agent and the quantity of the part of this binding agent relative to the used basic metal are appropriately balanced out, whereby the hardening heat treatment can be executed already at a temperature of about 950° C, whereby the workpiece is practically neither deformed nor shrinking. The sintered casting is formed to the desired shape and afterwards polished before the hardening heat treatment. As the heating of the workpiece during the heat treatment is less than its heating during sintering, practically no change in the structure occurs and the dimensions remain stable. Experience has shown that in practice the variations in the dimension are less than 0.05 %. The surface finish does practically not change, the quality of the surface obtained by polishing remaining essentially during the hardening.

The following description relates to examples of the process according to the invention and to workpieces manufactured according the new process. The details will be explained in connection with the manufacture of a part of a watch case.

Examples of successful basic metals are one of the metals of the groups 4A, 5A and 6A or a mixture of a majority of those metals, whereby titanium, zirconium, hafnium, vanadium, niobium, tantalum, chrome, molybdenum, and tungsten are preferred. These metals are manufactured and sold in customary pulverulent form. The basic powdered metal can be mixed and kneaded according to a known process with a binding agent, which was obtained from a metal or a majority of metals of the groups 1B and 8 of the periodic system, preferentially copper, silver, gold, iron, cobalt, nickel, ruthenium, rhodium, palladium, osmium, iridium or platinum.

To facilitate the forming of the workpiece, a wax which serves as pressing aid can be added to the powdered metal.

In view to obtain a casting which is as much as possible free of pores after the sintering and to ensure a practically total sintering at the following explained temperatures, the respective part of binding agent must be kept relatively low. Preferentially the part of binding agent, relative to the total weight of the mixture, should amount to maximally 15 percent in weight.

The experience has shown that the binding agent should be selected in accordance with the basic metal since certain basic metals with certain binding agent result in less precise castings than with other binding agents.

The thus prepared powdered metal and the additive are pressed into a mould, whereby a body is obtained which after sintering forms the casting. The dimensions of the mould are chosen such that the dimensions of the casting are slightly greater than those of the chosen finished piece, accounting for the shrinking during sintering.

The pressure at the forming is about 3–8 $Mp/cm^2$. Before the actual sintering process starts, the added material can be eliminated at a temperature of slightly below 600° C. The sintering of the prepared mixture is performed preferentially in a controled hydrogen or cracked ammonia gas atmosphere or in a vacuum at a temperature of about 1400° C – 1500° C in a conventional pusher type heating furnace. The duration of the sintering process can be some minutes.

The hardness of the thus obtained casting is such, that the cutting processing is without problems and easy, corresponding to the usual conditions encountered in the manufacture of conventional parts of watchcases.

After the cutting processing at least the visible surfaces of the piece are finished, comprising mostly polishing those surfaces, whereby in view of the relatively low hardness of the piece conventional polishing methods can be used.

The last step is the hardening. In the presence of an appropriately chosen atmosphere, the basic metals used form extremely hard carbides, borides or nitrides. With a preparation of the workpiece as above described the hardening can be effected at a temperature of about 950° C. The piece can for example be heat treated in a furnace in the presence of an atmosphere containing nitrogen or carbon and/or a gas giving off hydrogen.

For the formation of the carburized surface layer the piece can also be wrapped into an appropriately chosen solid material, from which carbon can diffuse into its surface. This method, comprising the wrapping of selected solid material around the piece can be applied also for forming a boride layer thereon.

After the hardening heat treatment the pieces need only repolishing, which can be done without difficulties.

In the following, some examples are described. In the first example a powder containing 93 % in weight basic metal and 7 % in weight binding agent is prepared. The basic metal consists of 90 % molybdenum and 10 % tungsten, the binding agent of 80 % cobalt and 20 % nickel. After forming of this powder and sintering, the casting was turned and milled to the desired dimensions. The workpiece was then polished until all traces of porosity disappeared from the surface.

The hardening was performed at a temperature of 950° C in a atmosphere which contained $H_2$ 94.5 % by Volume
$C_2H_8$ 5.0 % by Volume
HCl 0.5 % by Volume with a duration of 48 hours.

The surface hardness of the resulting piece was 1300 – 1500 kp/mm$^2$.

Another example for the basic metal is:

Mo 50 % by weight
V 25 % by weight
Cr 25 % by weight

Another example for the binding agent is

Co 100 % by weight or

Ni 75 % by weight
Cu 25 % by weight

Another example for the hardening process is the following:

The workpiece is wrapped into an activated bor-containing powder envelope of a thickness of about 8–10 mm, whereby the duration of the treatment is 18 hours at 950° C.

The pieces resulting from the above described processes have a surface which is invariable as well against corrosion by oxydation in the presence of the atmospheric humidity as against wear by contact with hard solid materials. The surface is scratch resistant and therefore has a lasting bright and polished look.

The described process allows manufacture of a broad variety of workpieces such as visible parts of watch-cases, parts of wristlets, parts of watch-movements, elements of necklaces, cuff-links, display-plates, buttons, handles and others, that is, parts which should have an invariable, practically inalterable surface and are to be manufactured industrially in relatively great series.

Due to the possibility to polish the pieces before the hardening heat treatment, polishing in this case is much cheaper than when using powdered metals as basic material which contain already hard carbides or borides.

What is claimed is:

1. Process for the manufacture of a watch case or like workpiece having a surface highly resistant to wear and corrosion, said surface having a hardness of at least 1300 kp/mm$^2$, comprising the steps of;

a. pressing and sintering a powdered metal mixture comprising at least one base powdered metal selected from the group consisting of titanium, zirconium, hafnium, vanadium, niobium, tantalum, chromium, molybdenum, and tungsten, in admixture with at least one binder powdered metal selected from the group consisting of copper, silver, gold, iron, cobalt, nickel, ruthenium, rhodium, palladium, ormium, iridium and platinum, the proportion of said binder metal in said mixture being not more than about 15% of the total weight, at a temperature between about 1400° and about 1500° C to produce a substantially poreless unfinished workpiece;

b. forming said unfinished workpiece into finished shape by cutting and milling, and polishing the faces thereof;

c. subjecting the finished workpiece formed in step (b) to a surface hardening treatment at a temperature of about 950° C to transform at least a part of the metal in the surface to borides, carbides, or nitrides;

2. The process of claim 1 in which the total mixture of metals in step (a) contains not more than 7% of said binder metal, by weight.

3. The process of claim 1, in which said powdered metal mixture comprises 93% by weight of said base metal and 7% by weight of said binder metal, said base metal consisting of 90% by weight molybdenum and 10% by weight cobalt and 20% by weight nickel, and in which said surface hardening is performed at a temperature of 950° C in an atmosphere containing 94.5% hydrogen by volume, 5% propane by volume and 0.5% hydrogen chloride by volume, for a period of about 48 hours.

4. The process of claim 1, in which said base powdered metal consists of 50% by weight molybdenum, 25% by weight vanadium and 25% by weight chromium.

5. The process of claim 1, in which said binder metal consists of 100% by weight cobalt.

6. The process of claim 1, in which said binder metal consists of 75% by weight nickel and 25% by weight copper.

* * * * *